US011667353B2

(12) United States Patent
Ward et al.

(10) Patent No.: US 11,667,353 B2
(45) Date of Patent: Jun. 6, 2023

(54) BIMINI ARCH

(71) Applicant: Lippert Components, Inc., Elkhart, IN (US)

(72) Inventors: Thomas Ward, Downingtown, PA (US); Jeffrey Albrecht, Goshen, IN (US); Josh Black, Mishawaka, IN (US); Nick Plummer, Elkhart, IN (US); John Shotwell, Edwardsburg, MI (US); Christine Trowbridge, Bristol, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 109 days.

(21) Appl. No.: 17/234,124

(22) Filed: Apr. 19, 2021

(65) Prior Publication Data

US 2021/0323639 A1 Oct. 21, 2021

Related U.S. Application Data

(60) Provisional application No. 63/011,638, filed on Apr. 17, 2020.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC .... B63B 17/00; B63B 17/02; B63B 2017/026
USPC ..... 114/361
See application file for complete search history.

(56) References Cited

U.S. PATENT DOCUMENTS

| | | | | |
|---|---|---|---|---|
| 2,512,691 | A | 6/1950 | Smith et al. | |
| 4,694,773 | A | 9/1987 | Sparkes et al. | |
| 4,951,594 | A | 8/1990 | Feikema | |
| 6,945,188 | B2 * | 9/2005 | Eck | B63B 17/02 114/361 |
| 7,370,597 | B1 | 5/2008 | Schwindaman | |
| 7,389,737 | B1 | 6/2008 | Schwindaman | |
| 7,392,758 | B2 | 7/2008 | Metcalf | |
| 7,438,015 | B1 | 10/2008 | Schwindaman | |
| 7,490,574 | B2 | 2/2009 | Shearer et al. | |
| 7,717,054 | B2 | 5/2010 | Tevlin | |
| 7,798,089 | B2 | 9/2010 | McKeand | |
| 7,895,964 | B2 | 3/2011 | Russikoff | |
| 7,921,797 | B2 | 4/2011 | James | |
| 7,950,342 | B2 | 5/2011 | Russikoff | |
| 8,418,708 | B2 | 4/2013 | Benish et al. | |
| 8,752,498 | B1 | 6/2014 | Schwindaman et al. | |
| 9,027,500 | B2 | 5/2015 | Williams et al. | |
| 9,139,259 | B2 * | 9/2015 | Williams | B63B 17/02 |

(Continued)

*Primary Examiner* — Lars A Olson
(74) *Attorney, Agent, or Firm* — Nixon & Vanderhye P.C.

(57) ABSTRACT

A combination radar arch and bimini top includes a radar arch securable on a boat deck over a boat cabin and a bimini top assembly secured to the radar arch. The bimini top assembly includes at least one bimini top base secured on the radar arch, a bimini arm pivotally connected to the bimini top base, and a spring-loaded roller assembly secured to the radar arch and including a canopy connected between the radar arch and the bimini arm. The bimini top base has a drive mechanism coupled with the bimini arm that is configured to displace the bimini arm between a retracted position and an extended position.

18 Claims, 10 Drawing Sheets

(56) References Cited

U.S. PATENT DOCUMENTS

| | | | |
|---|---|---|---|
| 10,513,314 | B2 | 12/2019 | Parniske et al. |
| 2006/0124045 | A1 | 6/2006 | Tucker et al. |
| 2007/0079746 | A1 | 4/2007 | Finney et al. |
| 2015/0048130 | A1 | 2/2015 | Jesewitz |

* cited by examiner

BIMINI ARCH

CROSS-REFERENCES TO RELATED APPLICATIONS

This application claims the benefit of U.S. Provisional Patent Application Ser. No. 63/011,638, filed Apr. 17, 2020, the entire content of which is herein incorporated by reference.

STATEMENT REGARDING FEDERALLY SPONSORED RESEARCH OR DEVELOPMENT (NOT APPLICABLE)

BACKGROUND

The invention relates to a radar arch and bimini top assembly combination and, more particularly, to a bimini top assembly that is cooperable with a radar arch.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top generally includes a flexible canvas material secured to a foldable support frame that is erected across the deck and is pivotally attached. These standard types of foldable bimini tops can be raised when needed or lowered into a substantially flat position on the deck when not in use or when an overhead obstruction may otherwise require it to be lowered.

Existing framework generally used to construct present bimini top installations includes a system of poles or like rigid members mounted to the port and starboard sides of the boat and made to extend across the deck at a sufficient height level to support the canvas top above the occupants. As currently arranged and implemented, these pole systems typically have separate front and rear pole members over which the canvas top is extended and, depending on the length of the top from fore to aft, one or more additional pole members between the front and rear poles to firmly support the intermediate section of the top. The pole members tend to obstruct a person on board from reaching out over the side of the boat when fishing, docking or mooring the boat and further present an obstacle in boarding and loading equipment onto the deck. While these and other similarly devised implementations of convertible bimini tops have been effective in providing suitable shade protection from the sun when needed, they have not satisfactorily resolved the problems of obstructions and obstacles caused in and around the boat deck by their supporting framework.

Separately, radar arches have become quite popular and are attached to, and upwardly extend from, the deck or superstructure (such as a flybridge) of boats. These radar arches are useful for attaching antennas and radar systems thereto. Deck lights and stereo speakers are also typically found connected to these radar arches. However, despite their relatively high expense, very little additional utility has been made of radar arches. In fact, on many boats which include both convertible tops and radar arches, the two are completely free standing one to another thus having the appearance of a discontinuity of design.

SUMMARY

A radar arch may be provided with a spring-loaded roller storing a canopy at its top end and a base at the end of at least one arch leg. Housed within the body of the at least one arch leg is a driving mechanism for pivoting a bimini arm between an extended position for providing shade and a retracted position. The driving mechanism may be motorized. In some embodiments, the bimini arm may be provided with curves to lie flat with the radar arch in the stowed or retracted position. Additionally, the spring-loaded roller may be cambered to create a curved shade when deployed to mitigate the pooling of water or dirt. The bottom of the at least one radar arch leg may include another drive mechanism or pivot mechanism for pivoting the radar arch between use and stowed positions for draining water or for stowing when the boat is not in use.

In some embodiments, a bimini top assembly kit may be secured to an existing radar arch. The kit includes structure for supporting the bimini top base or bases including the driving mechanism to which a bimini arm may be pivotally connected. The spring-loaded roller assembly is similarly secured to the radar arch top and includes a canopy connectable between the radar arch top and the bimini arm.

In an exemplary embodiment, a radar arch includes at least one radar arch leg securable on a cabin, a radar arch top extending from an end of the at least one radar arch leg, a bimini top base secured to an opposite end of the at least one radar arch leg, and a bimini arm pivotally connected to the bimini top base. The bimini arm is pivotable between a retracted position and an extended position. A spring-loaded roller assembly secured to the radar arch top includes a canopy connected between the radar arch top and the bimini arm. The bimini top base includes a drive mechanism coupled with the bimini arm that is configured to displace the bimini arm between the retracted position and the extended position.

The at least one radar arch leg may be curved, and the bimini arm may be curved corresponding to the at least one radar arch leg. The drive mechanism may include a piston displaceable back and forth and a rack, where the bimini arm has a gear sector at a distal end engaging the rack. The drive mechanism may be motorized or non-motorized.

The radar arch may also include radar arch legs securable on opposite sides of the cabin, where the radar arch legs may be secured to radar arch leg bases, respectively, and where the radar arch legs may be pivotable relative to the radar arch bases between a use position and a stowed position. At least one of the radar arch leg bases may include a pivot mechanism configured to displace the radar arch between the use position and the stowed position. The pivot mechanism may be motorized or non-motorized. In this context, the pivot mechanism may include a shuttle displaceable back and forth and including gear teeth, where the radar arch legs may include gear members at distal ends respectively engaging the gear teeth.

The spring-loaded roller assembly may be cambered to create a curved shade when deployed.

In another exemplary embodiment, a combination radar arch and bimini top includes a radar arch securable on a boat deck over a boat cabin, and a bimini top assembly secured to the radar arch. The bimini top assembly includes a pair of bimini top bases secured on opposite sides of the radar arch, a bimini arm pivotally connected to the bimini top bases that is pivotable between a retracted position and an extended position, and a spring-loaded roller assembly secured to the radar arch and including a canopy connected between the radar arch and the bimini arm. At least one of the bimini top bases includes a drive mechanism coupled with the bimini arm that is configured to displace the bimini arm between the retracted position and the extended position.

In yet another exemplary embodiment, a bimini top assembly kit securable to an existing radar arch includes a pair of support brackets securable to the existing radar arch, a pair of bimini top bases one each respectively secured to the each of the support brackets, a bimini arm pivotally connected to the bimini top bases and pivotable between a retracted position and an extended position, and a spring-loaded roller assembly securable to the radar arch and including a canopy connected to the bimini arm. At least one of the bimini top bases includes a drive mechanism coupled with the bimini arm that is configured to displace the bimini arm between the retracted position and the extended position. The drive mechanism may include U-shaped brackets at opposite ends thereof configured for supporting the drive mechanism on contoured surfaces.

BRIEF DESCRIPTION OF THE DRAWINGS

These and other aspects and advantages will be described in detail with reference to the accompanying drawings, in which.

DETAILED DESCRIPTION

Figure 1:
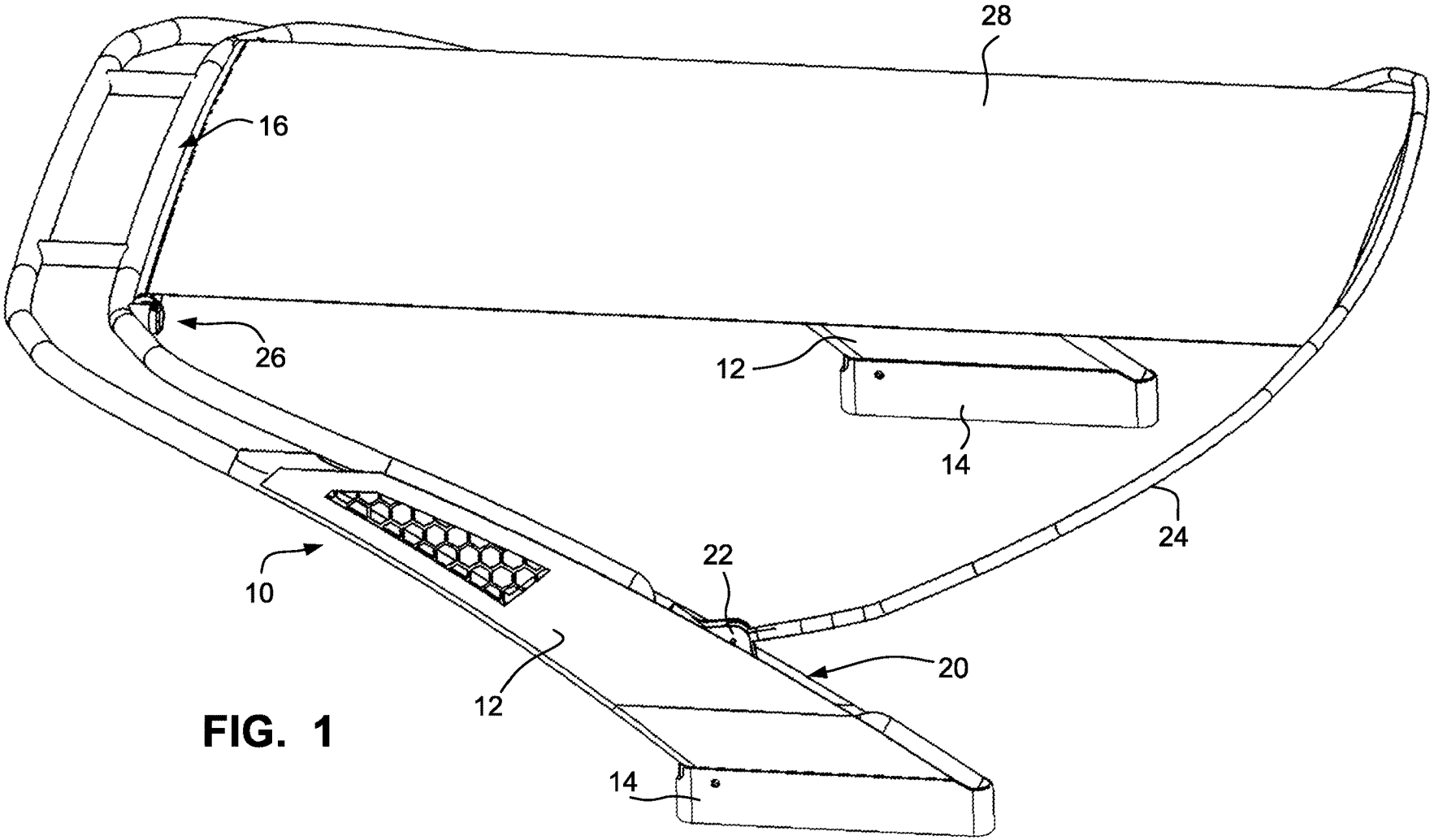
FIG. 1 is a perspective view of a combination radar arch and bimini top according to the described embodiments.
Figure 2:
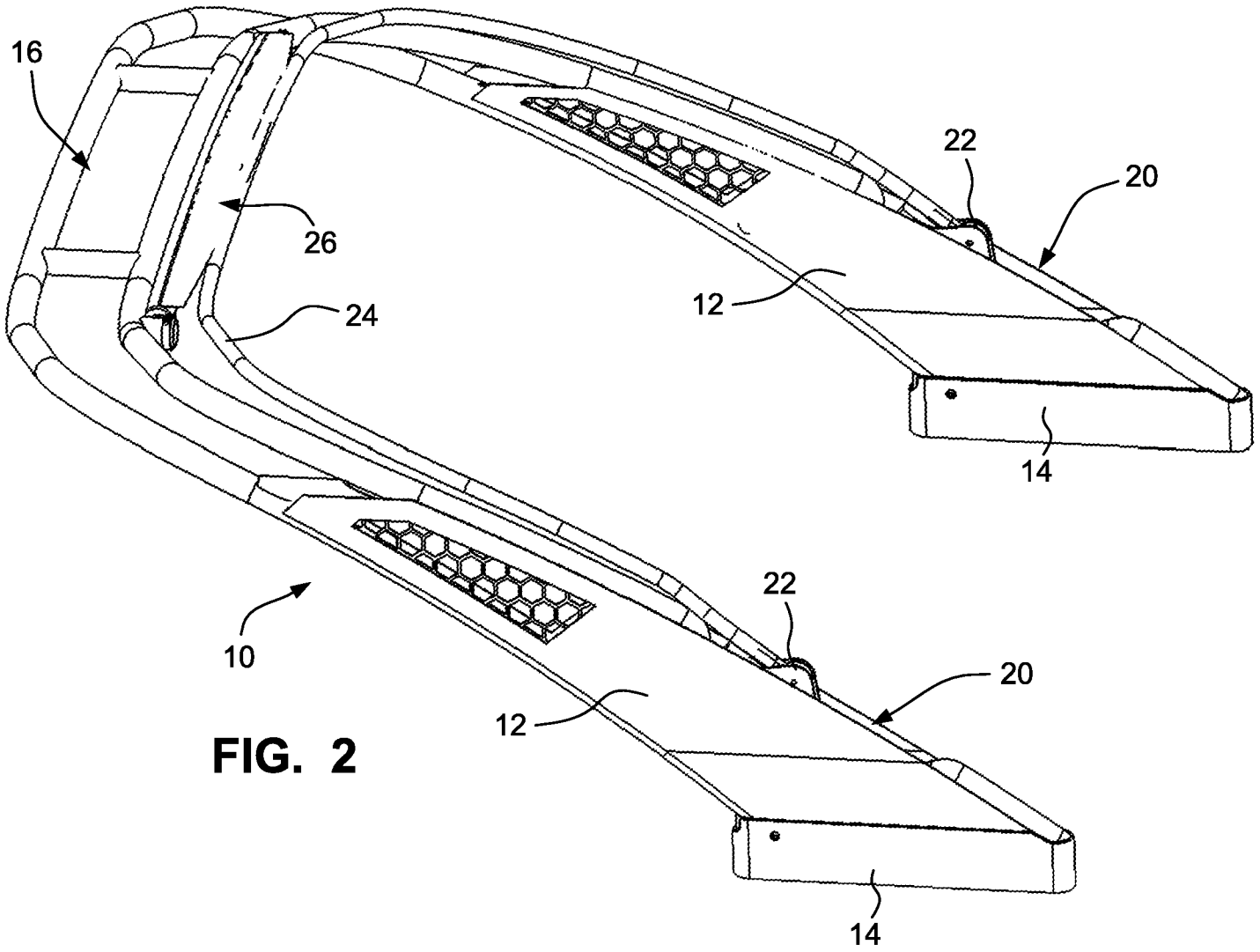
FIG. 2 is a perspective view thereof with the bimini top assembly in a retracted position.

FIGS. 1 and 2 show an exemplary radar arch 10 according to the described embodiments. The structure, use and operation of radar arches in a marine environment generally are known, and these details will not be described. The radar arch 10 includes a at least one radar arch leg 12, and preferably a pair of radar arch legs 12, securable to a boat deck or the like on opposite sides of a boat cabin. In some embodiments, the radar arch legs 12 are secured to the boat deck via radar arch leg bases 14. A radar arch top 16 extends between the radar arch legs 12.

Figure 4:
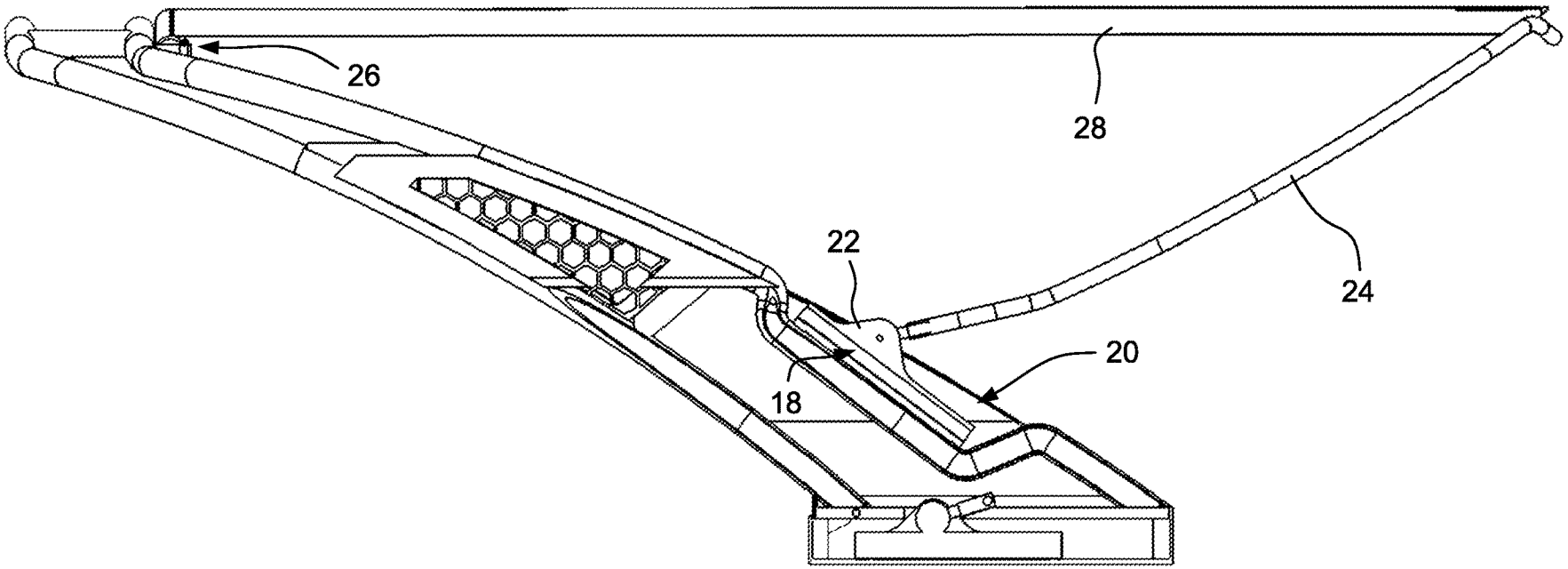
FIG. 4 is a side view with the bimini top assembly in an extended position.
Figure 5:
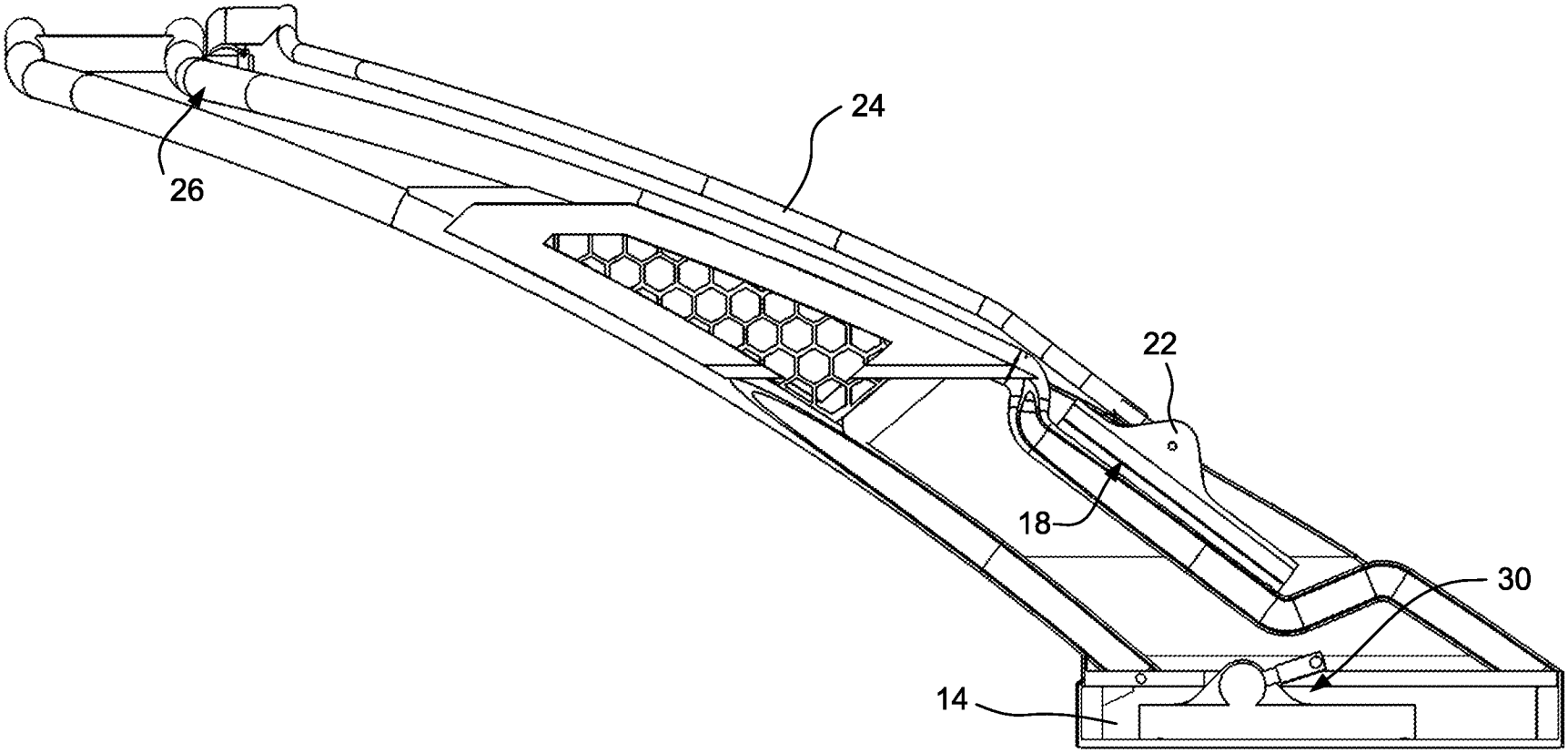
FIG. 5 is a side view with the bimini top assembly in a retracted position.

The radar arch 10 also includes a pair of bimini top bases 18 (see, for example, FIGS. 4 and 5) one each respectively secured to each of the radar arch legs 12. The radar arch legs 12 may include a recess 20 or the like for securing and/or concealing the bimini top bases 18. The bimini top bases 18 include bimini arm support brackets 22 that extend out of the recesses 20.

A bimini arm 24 is pivotally connected to the bimini top bases 18 via the support brackets 22. The bimini arm 24 is pivotable between a retracted position (FIG. 2) and an extended position (FIG. 1).

A spring-loaded roller assembly 26 is secured to the radar arch top 16 and includes a canopy 28 connected between the radar arch top 16 and the bimini arm 24. The roller assembly 26 is a known construction. Generally, the roller is biased to retract the canopy 28. When the bimini arm 24 is pivoted from the retracted position to the extended position, the canopy 28 is extended against the bias of the spring roller 26. When the bimini arm 24 is retracted, the roller assembly 26 automatically rolls the canopy into a stored position via the bias of the spring.

At least one and preferably both of the bimini top bases 18 include a drive mechanism coupled with the bimini arm 24 that is configured to displace the bimini arm 24 between the retracted position and the extended position. The drive mechanism may be motorized or non-motorized. In an exemplary embodiment, the drive mechanism may include a piston displaceable back and forth and including a rack, where the bimini arm 24 includes a gear sector at a distal end engaging the rack. As the rack is displaced back and forth by the piston, rack teeth on the rack engage gear teeth on the gear sector to displace the bimini arm 24. The exemplary drive mechanism is similar to the drive mechanism described in U.S. Pat. No. 7,389,737, the contents of which are hereby incorporated by reference.

Figure 3:
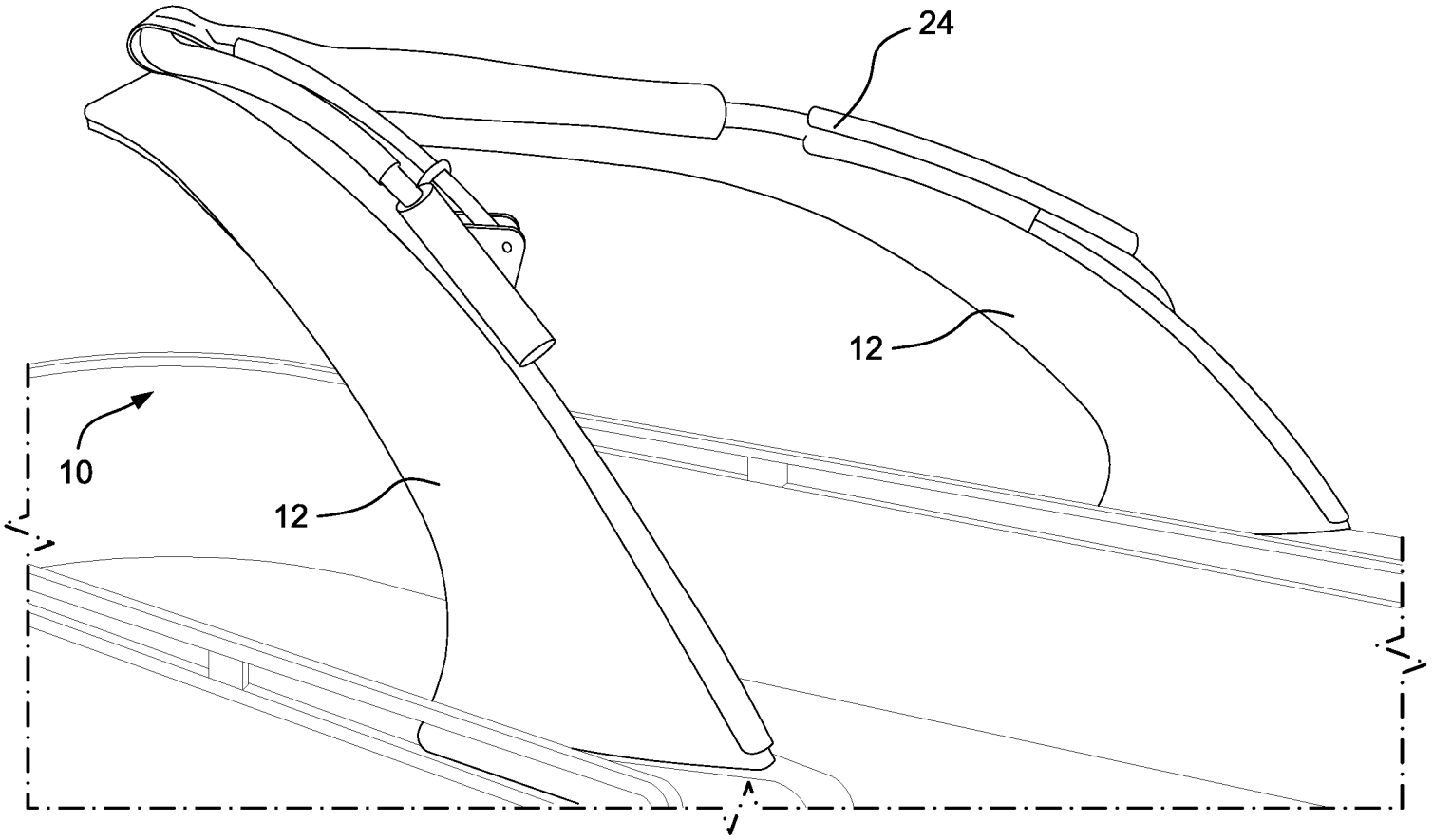
FIG. 3 shows an exemplary commercial application of the combination radar arch and bimini top.

In some embodiments, the radar arch legs 12 are curved, and the bimini arm 24 may be curved corresponding to the radar arch legs 12 (see, for example, FIG. 3). The curved bimini arm 24 enables the bimini arm 24 to lie flat with the radar arch in the retracted position. Additionally, the roller assembly 26 may be cambered to create a curved shade when deployed to mitigate the pooling of water or dirt. See, for example, U.S. Pat. No. 7,895,964, the contents of which are hereby incorporated by reference.

Figure 6:
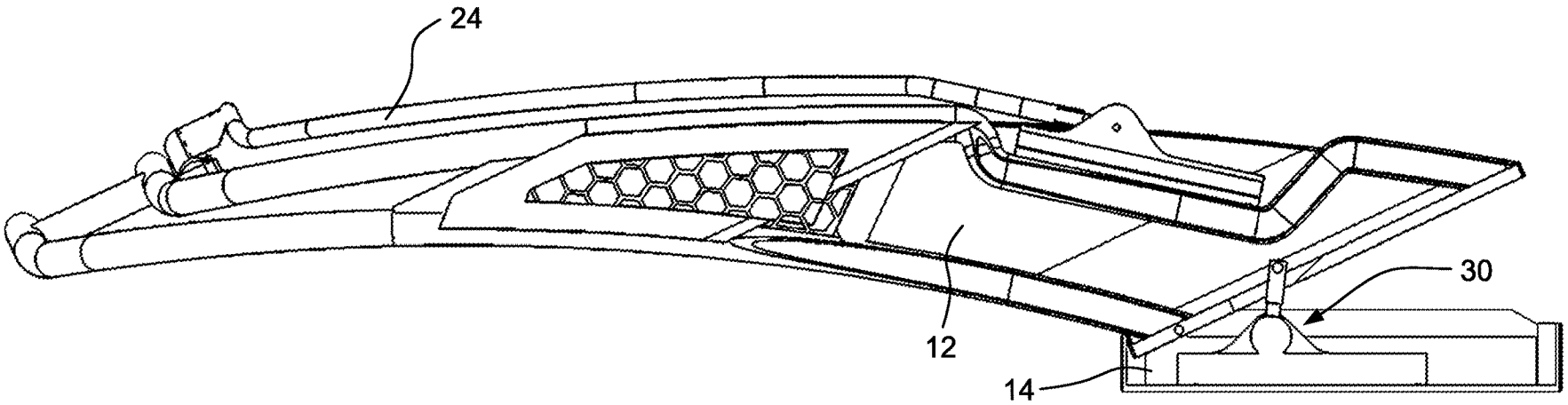
FIG. 6 is a side view showing the radar arch pivoted to a stowed position.

The radar arch itself may be pivotable on the radar arch leg bases 14 between a use position (FIG. 5) and a stowed position (FIG. 6). At least one and preferably both of the radar arch leg bases 14 include a pivot mechanism 30 that is configured to displace the radar arch between the use position and the stowed position. The radar arch is thus pivotable between upright and horizontal positions for draining water or for stowage when the boat is not in use. Similar to the driving mechanism for the bimini arm 24, the pivot mechanism 30 may be motorized or non-motorized. In a motorized version, the pivot mechanism 30 may include a piston or shuttle displaceable back and forth and including a rack with gear teeth. The radar arch legs 12 may be provided with gear members at distal ends respectively engaging the gear teeth.

Figure 7:
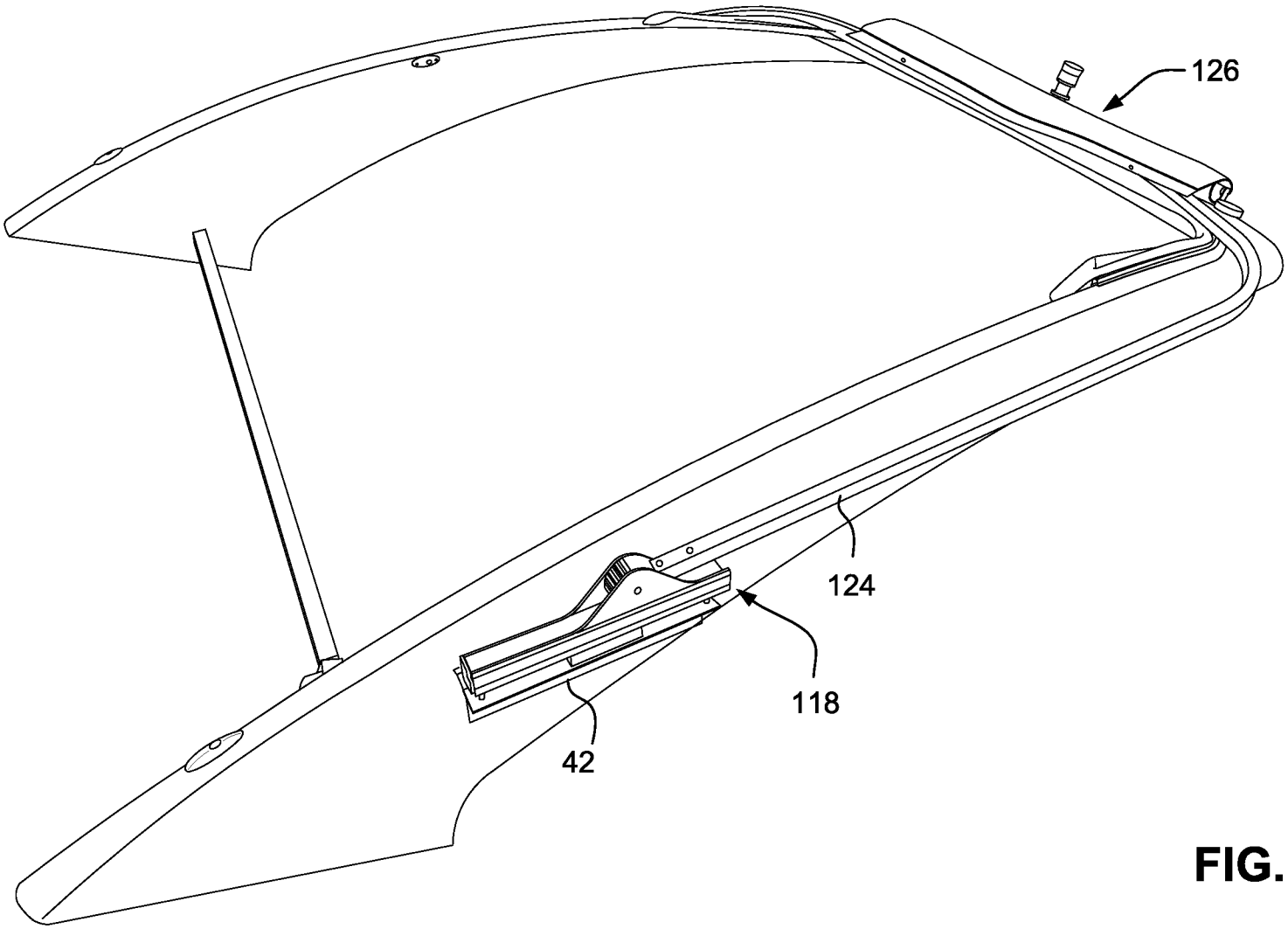
FIGS. 7-9 show the bimini top assembly kit securable to an existing radar arch.
Figure 8:
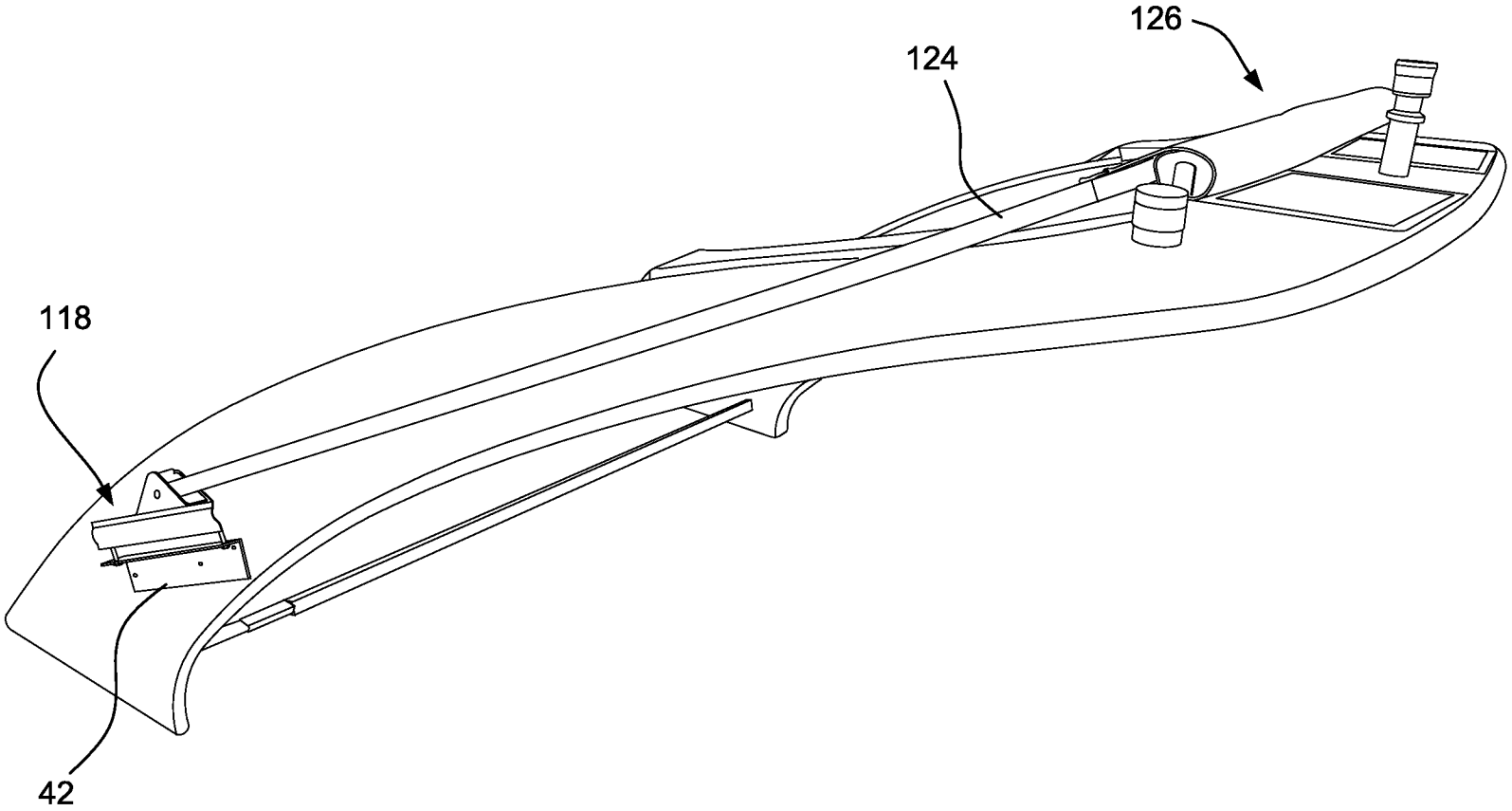
Figure 9:
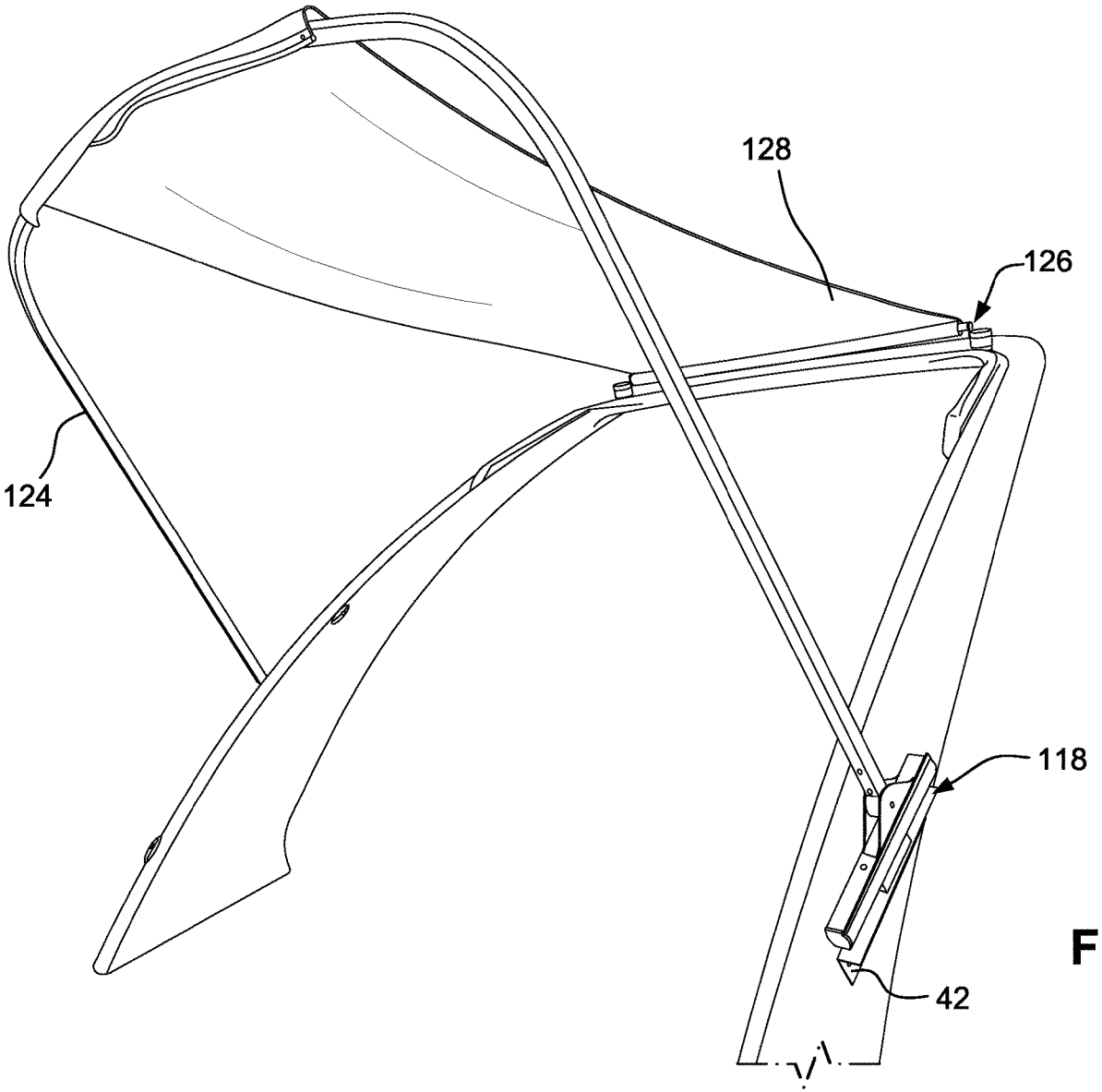

FIGS. 7-9 show a bimini top assembly kit securable to an existing radar arch. The kit will enable use of a bimini top assembly to an existing radar arch. The kit includes a pair of support brackets 42 securable to the existing radar arch. The support brackets 42 may be secured on exterior surfaces of the radar arch legs as shown. In some embodiments, the support brackets 42 are L-shaped brackets with one side of the L-shape secured to the radar arch, and the other side of the L-shape serving as a platform for securing the bimini top bases 118. The bimini top bases 118 are respectively secured to each of the support brackets 42 as shown. The bimini arm 124 is connected to the bimini top bases 118 in a manner similar to that described with reference to FIGS. 1-6. The kit also includes a spring-loaded roller assembly 126 securable to the radar arch and including a canopy 128 connected to the bimini arm 124. The kit may similarly include a drive mechanism in one or both of the bimini top bases 118. The kit is suitable as an aftermarket product that can be added to an existing radar arch.

Figure 10:
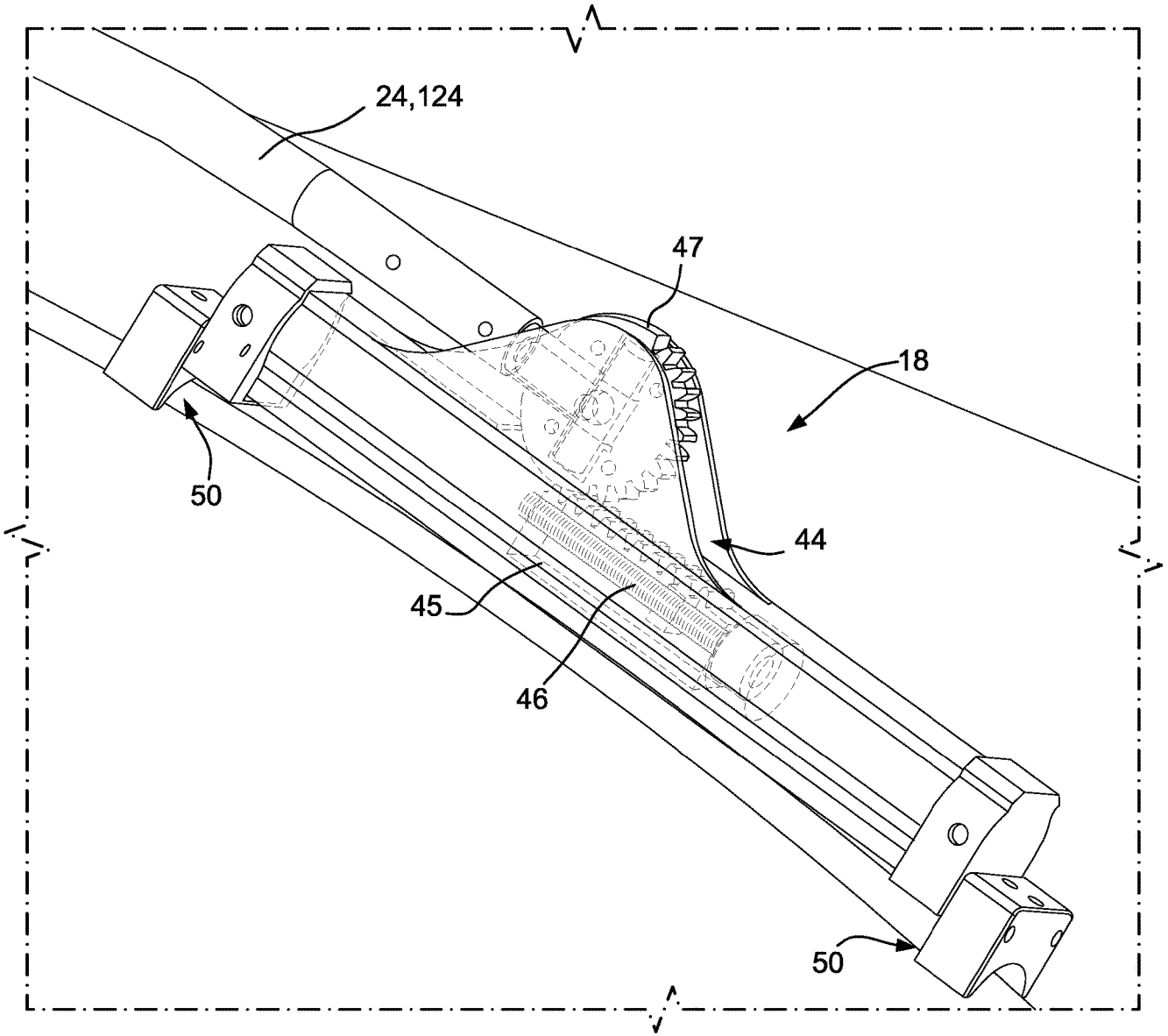
FIG. 10 shows an exemplary drive mechanism for the bimini top assembly.

FIG. 10 shows an exemplary drive mechanism 44 for the bimini top assembly. The drive mechanism includes a rack 45 driven by a piston or worm gear 46. A gear sector 47 is connected at ends of the bimini arm 24, 124 and engages the rack 45. Displacement of the piston or worm gear 46 causes corresponding displacement of the bimini arm 24, 124 to extend and retract the bimini top assembly. The gear sector 47 can be installed in any suitable fashion, and in an exemplary embodiment, the gear joint is similar to the universal joint described in U.S. Pat. No. 2,512,691, the contents of which are hereby incorporated by reference.

As shown in FIG. 10, the bimini top base 18 may include a pair of U-shaped brackets 50 to facilitate mounting to contoured surfaces such as rounded fiberglass boat decks or structural arches. A benefit of the U-shaped brackets 50 is that it provides a greater degree of freedom and room for error to the mounting of the drive mechanism 44. In some prior art the drive mechanisms, which are generally mounted on a flat surface, the gears between the two actuators must be coaxial and the planes defined by the gear faces must be parallel. If these conditions are not met, the system has a high likelihood of binding during actuation. The U-shaped brackets shown in FIG. 10 allow for added degrees of rotation or movement of the gear drive and arm without causing the bimini mechanism to bind. Moreover, the brackets 50 can serve to raise the mechanism to accommodate a fore to aft curved deck section. As noted, the brackets are particularly well-suited for installing drive mechanisms on contoured surfaces such as rounded fiberglass boat decks or structural arches because of the added degrees of freedom.

The described embodiments provide advantageous use of a radar arch to incorporate a bimini top assembly. By integrating the bimini top assembly with a radar arch, discontinuity of separate products can be avoided providing for a more streamlined appearance and a more efficient design. Additionally, the described kit enables boat owners to add a bimini top assembly to an existing radar arch without adding obstructions or obstacles on the boat deck.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A radar arch comprising:

at least one radar arch leg securable on a cabin;

a radar arch top extending from an end of the at least one radar arch leg;

a bimini top base secured to an opposite end of the at least one radar arch leg;

a bimini arm pivotally connected to the bimini top base, the bimini arm being pivotable between a retracted position and an extended position; and a spring-loaded roller assembly secured to the radar arch top and including a canopy connected between the radar arch top and the bimini arm, wherein the bimini top base comprises a drive mechanism coupled with the bimini arm that is configured to pivotably displace the bimini arm between the retracted position and the extended position.

2. A radar arch according to claim 1, wherein the at least one radar arch leg is curved, and wherein the bimini arm is curved corresponding to the at least one radar arch leg.

3. A radar arch according to claim 1, wherein the drive mechanism comprises a piston displaceable back and forth and including a rack, and wherein the bimini arm comprises a gear sector at a distal end engaging the rack.

4. A radar arch according to claim 1, wherein the drive mechanism is motorized.

5. A radar arch according to claim 1, wherein the drive mechanism is non-motorized.

6. A radar arch according to claim 1, further comprising radar arch legs securable on opposite sides of the cabin, wherein the radar arch legs are secured to radar arch leg bases, respectively, and wherein the radar arch legs are pivotable relative to the radar arch bases between a use position and a stowed position.

7. A radar arch according to claim 6, wherein at least one of the radar arch leg bases comprises a pivot mechanism that is configured to displace the radar arch between the use position and the stowed position.

8. A radar arch according to claim 7, wherein the pivot mechanism is motorized.

9. A radar arch according to claim 8, wherein the pivot mechanism comprises a shuttle displaceable back and forth and including gear teeth, and wherein the radar arch legs comprise gear members at distal ends respectively engaging the gear teeth.

10. A radar arch according to claim 7, wherein the pivot mechanism is non-motorized.

11. A radar arch according to claim 1, wherein the spring-loaded roller assembly is cambered to create a curved shade when deployed.

12. A combination radar arch and bimini top comprising:

a radar arch securable on a boat deck over a boat cabin; and a bimini top assembly secured to the radar arch, the bimini top assembly comprising:

a pair of bimini top bases secured on opposite sides of the radar arch, a bimini arm pivotally connected to the bimini top bases, the bimini arm being pivotable between a retracted position and an extended position, and a spring-loaded roller assembly secured to the radar arch and including a canopy connected between the radar arch and the bimini arm, wherein at least one of the bimini top bases comprises a drive mechanism coupled with the bimini arm that is configured to pivotably displace the bimini arm between the retracted position and the extended position.

13. A combination radar arch and bimini top according to claim 12, wherein the drive mechanism is motorized.

14. A combination radar arch and bimini top according to claim 12, wherein the radar arch is securable to the boat deck via a pair of radar arch bases, and wherein at least one of the radar arch bases comprises a pivot mechanism that is configured to displace the radar arch relative to the radar arch bases between a use position and a stowed position.

15. A combination radar arch and bimini top according to claim 14, wherein the pivot mechanism is motorized.

16. A bimini top assembly kit securable to an existing radar arch, the bimini top assembly kit comprising:

a pair of support brackets securable to the existing radar arch;

a pair of bimini top bases one each respectively secured to the each of the support brackets;

a bimini arm pivotally connected to the bimini top bases, the bimini arm being pivotable between a retracted position and an extended position; and a spring-loaded roller assembly securable to the radar arch and including a canopy connected to the bimini arm, wherein at least one of the bimini top bases comprises a drive mechanism coupled with the bimini arm that is configured to pivotably displace the bimini arm between the retracted position and the extended position.

17. A bimini top assembly kit according to claim 16, wherein the drive mechanism is motorized.

18. A bimini top assembly kit according to claim 16, wherein the drive mechanism comprises U-shaped brackets at opposite ends thereof configured for supporting the drive mechanism on contoured surfaces.

* * * * *